US007958568B2

(12) United States Patent
Fisher et al.

(10) Patent No.: US 7,958,568 B2
(45) Date of Patent: Jun. 14, 2011

(54) GLOVE WITH SUPPORT SYSTEM

(75) Inventors: Sam Fisher, Beaverton, OR (US); Antonio Spampinato, Aloha, OR (US); Richard Avis, Tigard, OR (US)

(73) Assignee: Nike, Inc., Beaverton, OR (US)

( * ) Notice: Subject to any disclaimer, the term of this patent is extended or adjusted under 35 U.S.C. 154(b) by 70 days.

(21) Appl. No.: 12/501,399

(22) Filed: Jul. 10, 2009

(65) Prior Publication Data

US 2009/0271913 A1 Nov. 5, 2009

Related U.S. Application Data

(63) Continuation of application No. 11/368,995, filed on Mar. 7, 2006, now Pat. No. 7,574,748.

(51) Int. Cl.
*A41D 13/08* (2006.01)

(52) U.S. Cl. ..... 2/16; 2/160

(58) Field of Classification Search ..... 2/16, 20, 2/160, 163

See application file for complete search history.

(56) References Cited

U.S. PATENT DOCUMENTS

| | | | |
|---|---|---|---|
| 321,529 | A | 7/1885 | Rate |
| 1,268,103 | A | 6/1918 | Fleming |
| 1,316,292 | A | 9/1919 | Fleming |
| 1,337,957 | A | 4/1920 | Rasmussen |
| 1,388,618 | A | 8/1921 | Stein |
| 1,509,801 | A | 9/1924 | Walters |
| 1,951,190 | A | 3/1934 | Gambee |
| 4,272,849 | A | 6/1981 | Thurston et al. |
| 4,507,804 | A | 4/1985 | Consigny |
| 4,675,914 | A | 6/1987 | Mitchell |
| 4,766,612 | A | 8/1988 | Patton, Sr. |
| 5,453,064 | A | 9/1995 | Williams, Jr. |
| 5,628,069 | A | 5/1997 | Ebert |
| 5,794,261 | A | 8/1998 | Hefling |
| 6,010,473 | A | 1/2000 | Robinson |
| 6,058,503 | A | 5/2000 | Williams |
| 6,182,293 | B1 | 2/2001 | Mustin |
| 6,557,177 | B2 | 5/2003 | Hochmuth |
| 6,584,615 | B1 | 7/2003 | Wilder et al. |
| 6,654,964 | B1 | 12/2003 | Staihar et al. |
| 6,684,406 | B2 | 2/2004 | Fowler |
| 6,990,689 | B1 | 1/2006 | Thellmann |
| 7,574,748 | B2 | 8/2009 | Fisher et al. |
| 2004/0187190 | A1 | 9/2004 | Wilder et al. |
| 2005/0153153 | A1 | 7/2005 | Saur et al. |

FOREIGN PATENT DOCUMENTS

| | | |
|---|---|---|
| DE | 10010403 | 9/2001 |
| DE | 10010404 | 9/2001 |
| GB | 2311929 | 10/1997 |
| JP | 9262332 | 10/1997 |

(Continued)

OTHER PUBLICATIONS

European Search Report completed Jun. 11, 2010 in European Application No. 07758096.7.

(Continued)

*Primary Examiner* — Katherine Moran
(74) *Attorney, Agent, or Firm* — Plumsea Law Group, LLC

(57) ABSTRACT

A glove with a support system is disclosed. The support system comprises a number of individual support sections, each of which is comprised of a number of arcuate support segments that encircle a portion of a finger and allow forward flexural movement while helping to reduce hyperextension of the finger. The support system is also designed to help reduce the possibility of the finger jamming.

23 Claims, 17 Drawing Sheets

FOREIGN PATENT DOCUMENTS

| | | |
|---|---|---|
| JP | 11192335 | 7/1999 |
| WO | WO 00/53275 | 9/2000 |
| WO | WO 01/00052 | 1/2001 |
| WO | WO 01/64295 | 9/2001 |

OTHER PUBLICATIONS

Information Disclosure Statement filed Dec. 18, 2007 in U.S. Appl. No. 11/368,995.

Office Action mailed May 28, 2008 in U.S. Appl. No. 11/368,995.

Information Disclosure Statement filed Oct. 8, 2008 in U.S. Appl. No. 11/368,995.

Final Office Action mailed Dec. 11, 2008 in U.S. Appl. No. 11/368,995.

Notice of Allowance mailed Apr. 14, 2009 in U.S. Appl. No. 11/368,995.

International Premilinary Report on Patentability, mailed Sep. 18, 2008 from PCT Application No. PCT/US2007/063509.

GLOVE WITH SUPPORT SYSTEM

CROSS-REFERENCE TO RELATED APPLICATION

This application is a continuation of U.S. Pat. No. 7,574,748, currently U.S. application Ser. No. 11/368,995, entitled "Glove with Support System", filed on Mar. 7, 2006, and issued on Aug. 18, 2009, which is hereby incorporated by reference.

BACKGROUND

The present invention relates generally to protective athletic apparel and more particularly to a glove with a support system.

Gloves are traditionally worn to protect the hands and to improve gripping ability. Depending on the application, gloves may insulate the hands from temperature extremes, they may protect against harsh or hazardous environments, and they may protect the hands mechanically by diffusing or absorbing applied forces that would otherwise cause damage.

Protective gloves are particularly common in athletics. Most athletic gloves seek to increase gripping ability and to diffuse or absorb applied forces without interfering with the hand range of motion that is necessary for athletic tasks. Some athletic gloves seek to provide adequate hand range of motion while preventing potentially damaging movements of the hand.

One potentially damaging movement of the hand is hyperextension of the fingers. Flexion of the fingers enables the wearer to grip an object. However, if the fingers are hyperextended, i.e., straightened and pushed posteriorly, quickly or with great force, they can fracture or sustain other types of damage. Hyperextension of the fingers is a particular concern when the wearer seeks to catch an object moving at relatively high velocity.

In order to address the issue of hyperextension of the fingers, some athletic gloves include support systems that mechanically block hyperextension of the fingers. However, these athletic gloves typically inhibit flexion of the fingers.

SUMMARY

In one aspect, the invention provides a glove including a support system, that comprises at least one support structure including a first segment and an adjacent second segment; the first segment including a first mechanical connector including at least one hole, and a second mechanical connector including at least one post; the second segment including a first mechanical connector including at least one hole, and a second mechanical connector including at least one post; where the hole of the first mechanical connector of the first segment receives the post of the second mechanical connector of the second segment thereby connecting the first segment with the second segment; where the post pivots within the hole allowing the first segment to pivot with respect to the second segment; and where the post is integrally formed on the second connector.

In another aspect, the first segment is substantially similar to the second segment.

In another aspect, the first mechanical connector of the first segment includes a pair of holes disposed on first and second end portions.

In another aspect, a central portion extends between the first and second end portions.

In another aspect, the central portion includes a first edge disposed proximal to the first mechanical connector.

In another aspect, the invention provides a glove including a support system that comprises a support structure including a first segment and an adjacent second segment; the first segment including a first mechanical connector including at least one hole, and a second mechanical connector including at least one post; the second segment including a first mechanical connector including at least one hole, and a second mechanical connector including at least one post; where the first segment is connected to the second segment and where the first and second segments present a substantially smooth outer surface when connected.

In another aspect, the first and second segments present a substantially smooth inner surface when connected.

In another aspect, the first mechanical connector of the first segment includes an outer recessed portion, the outer recessed portion including a hole.

In another aspect, the second mechanical connector of the second segment includes an inner recessed portion, the inner recessed portion including a post.

In another aspect, the outer recessed portion of the first segment generally corresponds with the inner recessed portion of the second segment.

In another aspect, the post of the second mechanical connector of the second segment is received in the hole of the first mechanical connector of the first segment thereby connecting the first segment with the second segment.

In another aspect, the post pivots within the hole allowing the first segment to pivot with respect to the second segment.

In another aspect, the post is integrally formed on the second connector.

In another aspect, the invention provides a glove comprising a first layer configured to contact a wearer's hand; a support system associated with the inner layer comprising: a support structure including a plurality of segments; the support structure having a first segment configured to pivot with respect to at least one adjacent segment; an endcap support segment including a top portion configured to protect a fingertip of the wearer's hand; and wherein the endcap support segment is attached to the first segment and can pivot with respect to the first segment.

In another aspect, the endcap includes a mechanical connector that engages a corresponding mechanical connector of the first segment.

In another aspect, the endcap includes a mechanical connector that engages a corresponding mechanical connector of the first segment.

In another aspect, the glove includes a knuckle support segment configured to protect a knuckle of the wearer, wherein the knuckle support segment is configured to associate with at least one of the plurality of segments.

Other systems, methods, features and advantages of the invention will be, or will become, apparent to one of ordinary skill in the art upon examination of the following figures and detailed description. It is intended that all such additional systems, methods, features and advantages be included within this description and this summary, be within the scope of the invention, and be protected by the following claims.

BRIEF DESCRIPTION OF THE DRAWINGS

The invention can be better understood with reference to the following drawings and description. The components in the figures are not necessarily to scale, emphasis instead being placed upon illustrating the principles of the invention.

Moreover, in the figures, like reference numerals designate corresponding parts throughout the different views.

DETAILED DESCRIPTION

Figure 1:
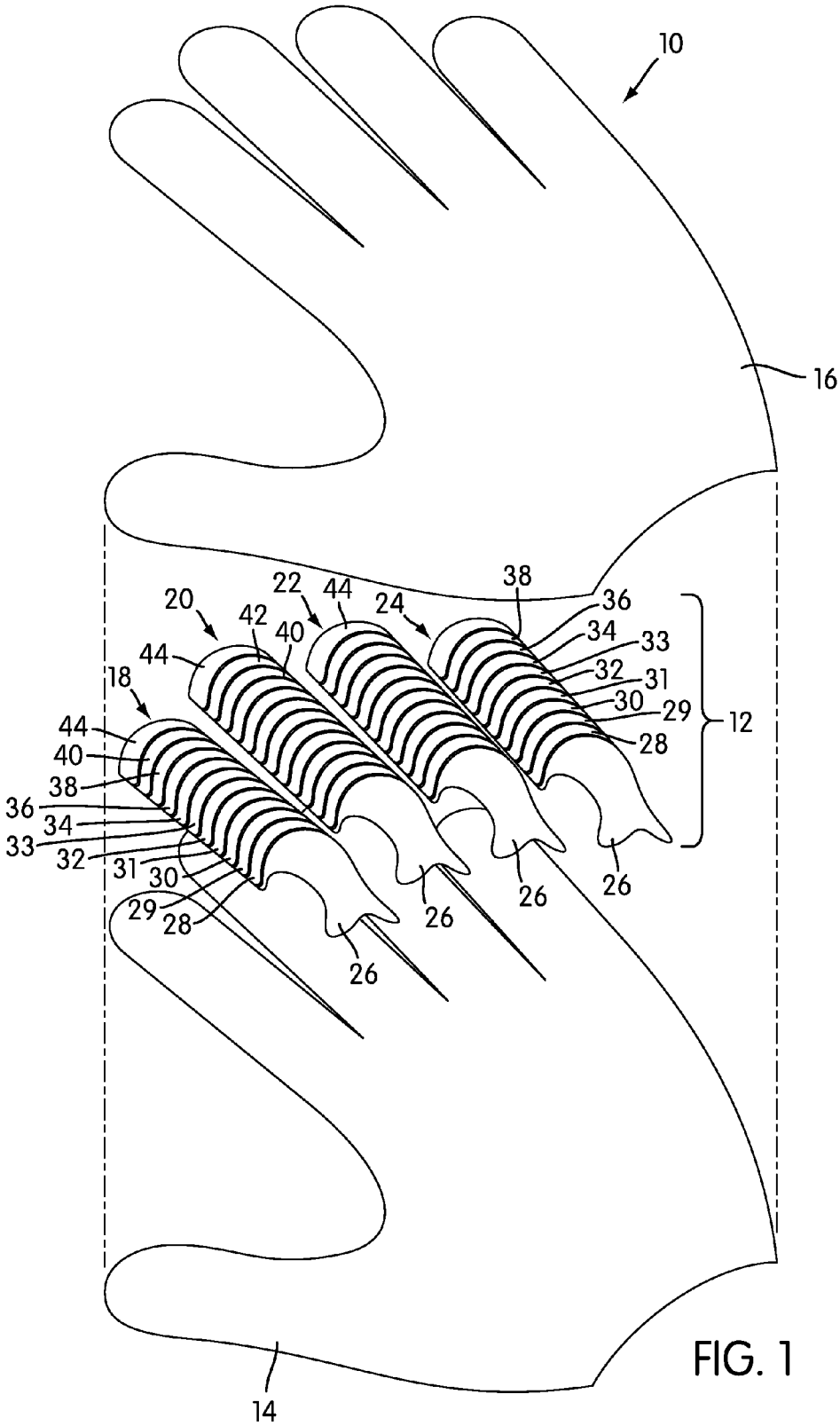
FIG. 1 is an exploded perspective view of a glove with a support system.

FIG. 1 is an exploded perspective view of a glove, generally indicated at 10, with a support system, generally indicated at 12. Glove 10 comprises at least two layers of a compliant, flexible material formed to the shape of a human hand. A first layer 14 of glove 10 is adapted to fit proximate to the anterior surface of the hand; a second layer 16 of glove 10 is adapted to fit proximate to the posterior surface of the hand. In FIG. 1, a right-handed glove is illustrated; a left-handed glove may be the mirror image of the right-handed glove.

In the description that follows, directional terms such as proximal, distal, anterior, and posterior will be used. These terms describe the orientation of glove 10 and the location of its components when glove 10 is worn on a hand, and are defined based on the standard anatomical position of the human hand.

In preferred embodiments, glove 10 is adapted for use as an athletic glove. In one particular preferred embodiment, glove 10 is adapted for use as a soccer goalie glove. Preferably, at least first layer 14 of glove 10 is adapted to increase tactility and gripping ability. Both first and second layers 14, 16 of glove 10 may, for example, be made of leather, synthetic leather, soft PVC, or nylon. First and second layers 14, 16 may also include pockets of foam or other cushioning material that absorb force and increase gripping ability. Depending on the embodiment, the materials of first layer 14 and second layer 16 may be the same or different. Additionally, in some embodiments, the layers and features of a left-handed glove may be different than the layers and features of a right-handed glove, depending on the application.

Support system 12 is disposed between first and second layers 14, 16 of glove 10, and may be secured between first and second layers 14, 16 in any desired manner. For example, support system 14 may be sewn into place between first and second layers 14, 16. Moreover, although not shown in FIG. 1, additional layers of fabric or other material may be sewn, fused to, or otherwise mounted on or between first and second layers 14, 16 in order to define pockets for support system 12.

Support system 12 comprises a plurality of support structures 18, 20, 22, 24, one for each of the four fingers on the hand. In the illustrated embodiment, no support structure is provided for the thumb, although a support structure could be included in other embodiments. Support structures 18, 20, 22, 24 are positioned within glove 10 such that when glove 10 is worn, each support structure 18, 20, 22, 24 extends from a proximal location adjacent the first knuckle to a distal location adjacent the tip of the finger.

Each support structure 18, 20, 22, 24 is sized for the particular finger that it is to support, and each comprises the following optional components: a proximal knuckle support segment 26, at least one middle support segment, preferably a plurality of middle support segments 28, 29, 30, 31, 32, 33, 34, 36, 38, 40, 42 connected to each other, and a distal endcap support segment 44. In order to accommodate longer finger length, those support structures 18, 20, 22, 24 that are adapted for longer fingers may have more middle support segments 28, 29, 30, 31, 32, 33, 34, 36, 38, 40, 42. The interconnection and manner of operation of support structures 18, 20, 22, 24 will be described in more detail below. Preferably, support segments 26, 28, 29, 30, 31, 32, 33, 34, 36, 38, 40, 42, 44 are made of a material having sufficient rigidity for the application. In some preferred embodiments, support segments 26, 28, 29, 30, 31, 32, 33, 34, 36, 38, 40, 42, 44 are made of a plastic, such as high density polyethylene (HDPE). In other embodiments, support segments 26, 28, 29, 30, 31, 32, 33, 34, 36, 38, 40, 42, 44 may be made of metal.

In general, support structures 18, 20, 22, 24 of glove 10 are adapted to prevent hyperextension of the fingers while allowing a full range of motion in flexture. As the term hyperextension is used here, it refers generally to any unwanted posterior (i.e., rearward) movement or position of any portion or joint of a finger, as well as specific positions that may be clinically described as hyperextended. It should be understood that one joint of a finger may be hyperextended even though other joints of that same finger are flexed.

Figure 2:
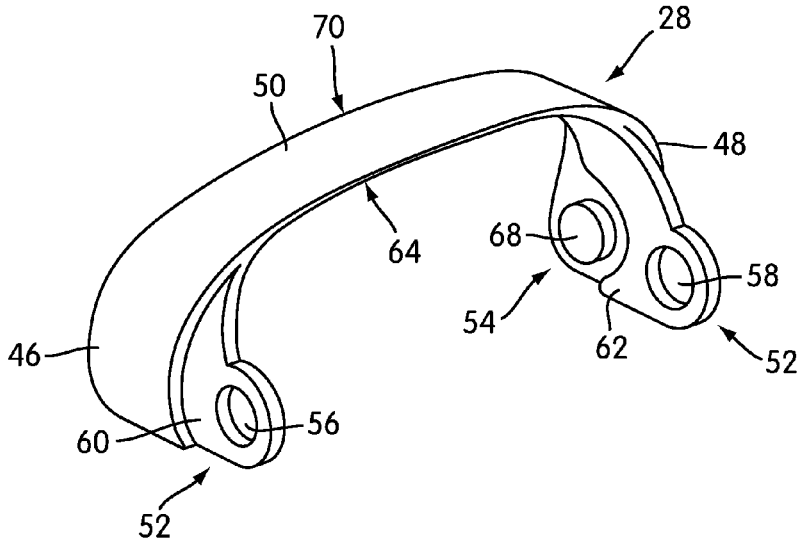
FIG. 2 is a top perspective view of a support segment of the support system of FIG. 1.
Figure 3:
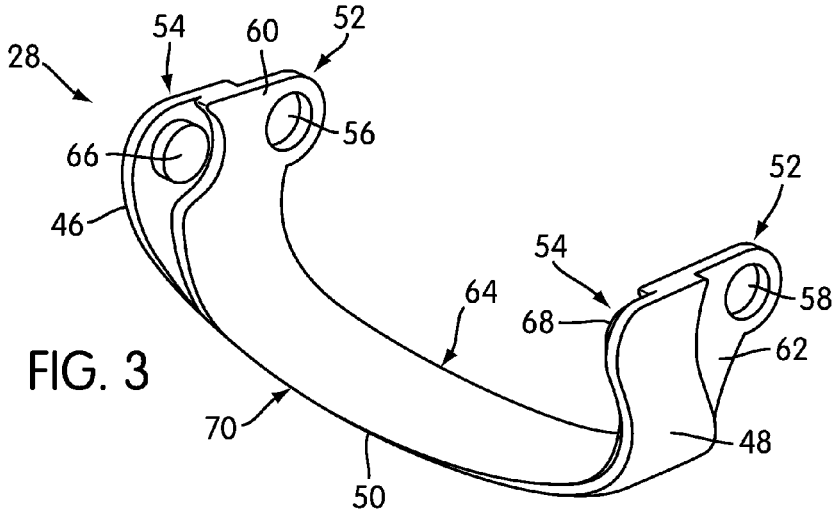
FIG. 3 is a bottom perspective view of the support segment of FIG. 2.

FIG. 2 is a top perspective view of one of middle support segments 28, 29, 30, 31, 32, 33, 34, 36, 38, 40, 42 in isolation, and FIG. 3 is a bottom perspective view. Although the middle support segments 28, 29, 30, 31, 32, 33, 34, 36, 38, 40, 42 may differ slightly in size or shape so as to be adapted for the various fingers or for a particular position along the finger, preferably, they are of substantially the same shape and size; therefore, for clarity, details of support segment 28 illustrated in FIGS. 2 and 3 are disclosed, keeping in mind that the teachings of support segment 28 can be applied to the other support segments 29, 30, 31, 32, 33, 34, 36, 38, 40, 42.

Support segment 28 has a generally arcuate shape, and is adapted to curve laterally around the finger that it is to support. In the illustrated embodiment, support segment 28 has curving first and second end portions 46, 48 connected by a relatively flat central portion 50. When glove 10 is worn, one of end portions 46, 48 extends around the medial aspect of the finger and the other end portion 46, 48 curves around the lateral aspect of the finger. In a preferred embodiment, support segment 28 extends over approximately 180° of the circumference of the finger, although greater and lesser extents are possible.

Each of the first and second end portions 46, 48 has a first mechanical connector 52 and a second mechanical connector 54. With respect to the anatomical coordinate system of the fingers, first mechanical connector 52 is configured to associate support segment 28 with a more distal support segment 29; second mechanical connector 54 is configured to associate support segment 28 with a more proximal support segment 26.

First mechanical connector 52 comprises first and second holes 56, 58 defined opposite one another in respective outwardly extending first and second connecting portions 60, 62. First and second connecting portions 60, 62 project distally from support segment 28 and arise as first and second end portions 46, 48 merges into central portion 50. As is shown in the figures, first and second connecting portions 60, 62 are slightly recessed so as to lie inwardly of a first edge 64 of support segment 28. First edge 64 of support segment 28 acts as the outermost edge of support segment 28 distally; its contours will be described in greater detail below.

Second mechanical connector 54 comprises first and second posts 66, 68 positioned opposite one another on opposite inwardly oriented faces of first and second end portions 46, 48. First and second posts 66, 68 are sized to fit within and cooperate with the respective first and second holes 56, 58 of an adjacent support segment and to extend inwardly so as to be flush with the respective first and second connecting portions 60, 62 when engaged in first and second holes 56, 58. Adjacent first and second posts 66, 68 is a second edge 70, which acts as the proximal outermost edge of support segment 28.

Figure 4:
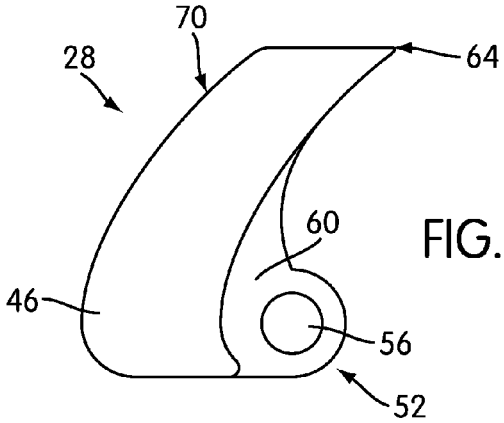
FIG. 4 is a side elevational view of the support segment of FIG. 2.
Figure 5:
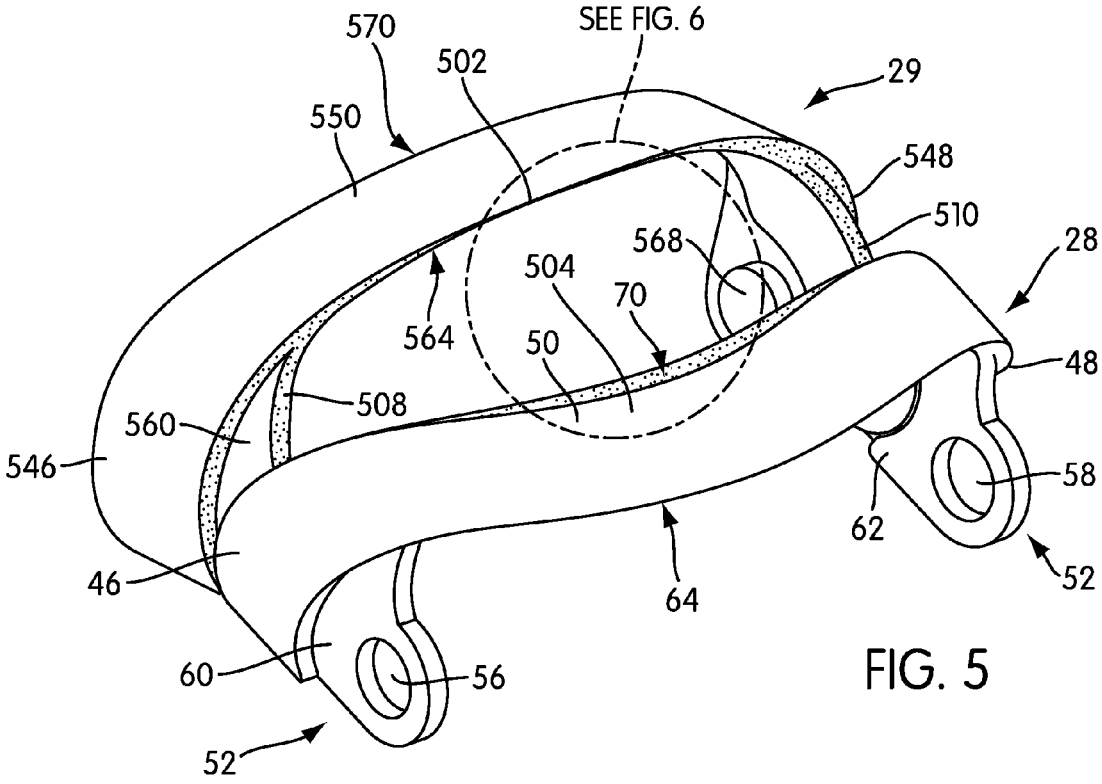
FIG. 5 is a front elevational view of the support segment of FIG. 2.
Figure 6:
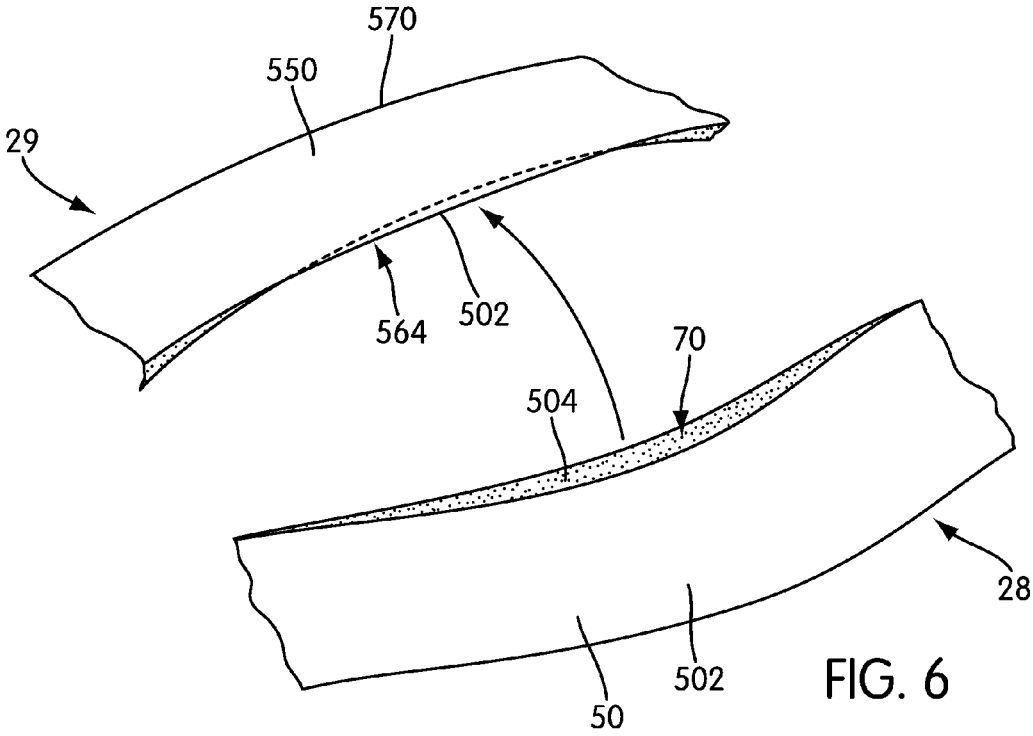
FIG. 6 is a back elevational view of the support segment of FIG. 2.
Figure 7:
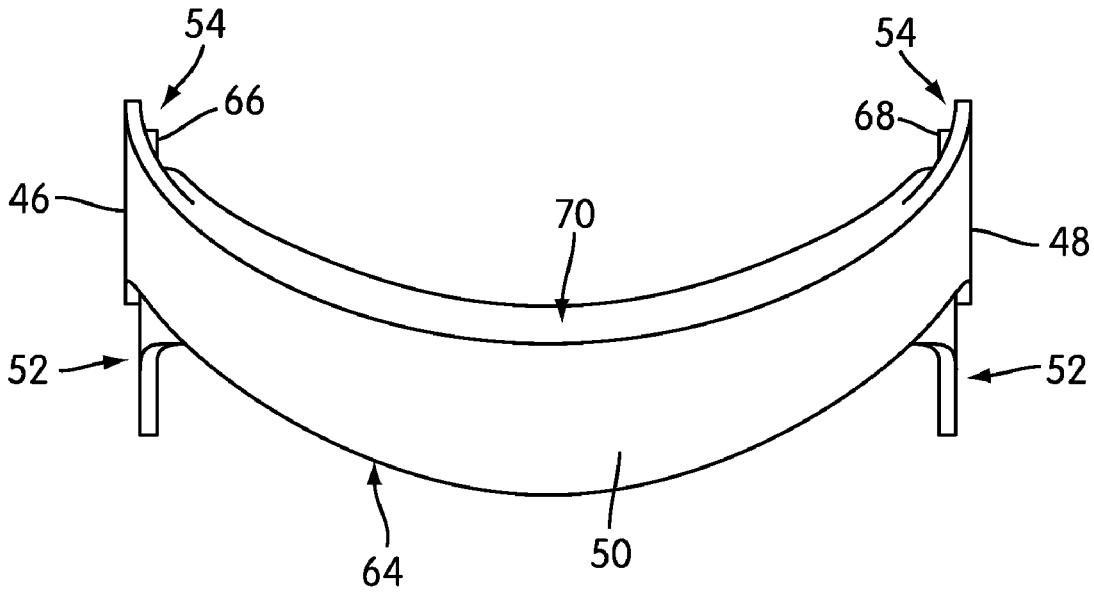
FIG. 7 is a top plan view of the support segment of FIG. 2.
Figure 8:
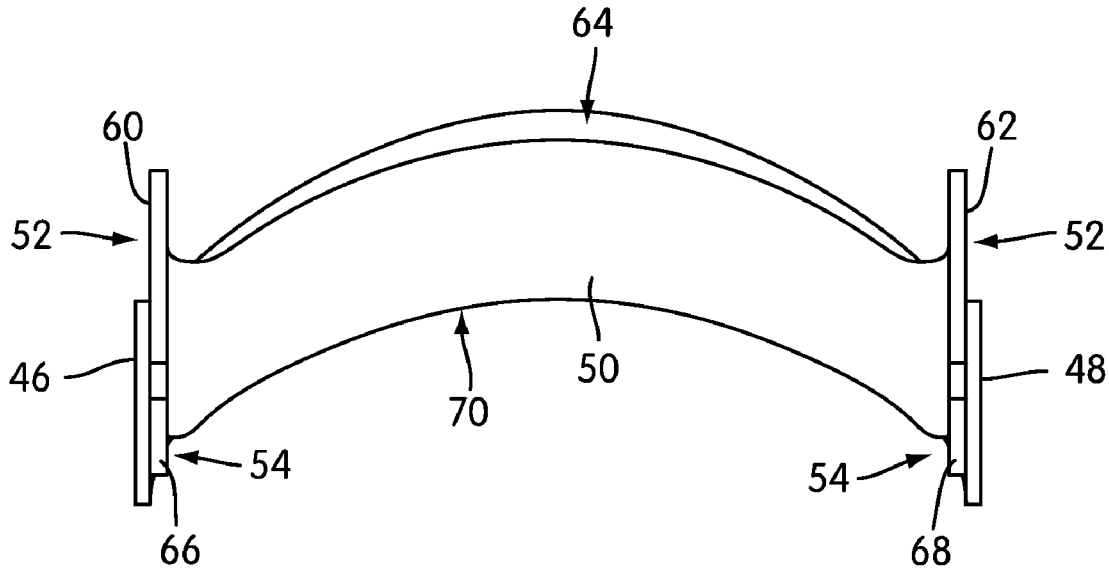
FIG. 8 is a bottom plan view of the support segment of FIG. 2.

FIG. 4 is a side elevational view of the support segment 28. As shown in FIG. 4, with respect to the coordinate system of the hand, central portion 50 and its first edge 64 extend farther in a distal direction than first and second posts 66, 68. The overall curvature of central portion 50 and the extent of its first and second edges 64, 70 can also be seen in FIGS. 7 and 8, which are, respectively, top and bottom plan views of support segment 28. FIGS. 5 and 6 are, respectively, front and back elevational views showing the overall arcuate curvature of support segment 26.

Figure 9:
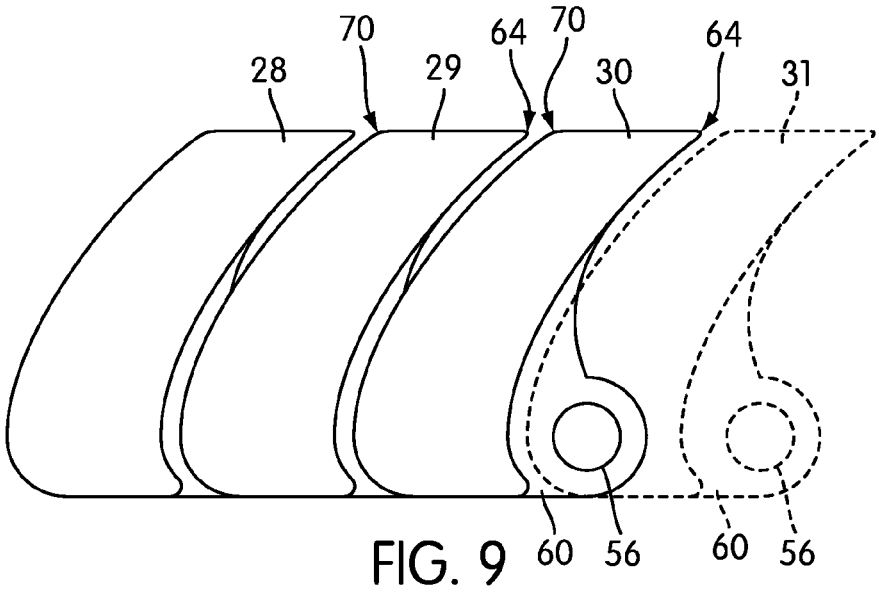
FIG. 9 is a side elevational view of several support segments, illustrating their interconnection.
Figure 10:
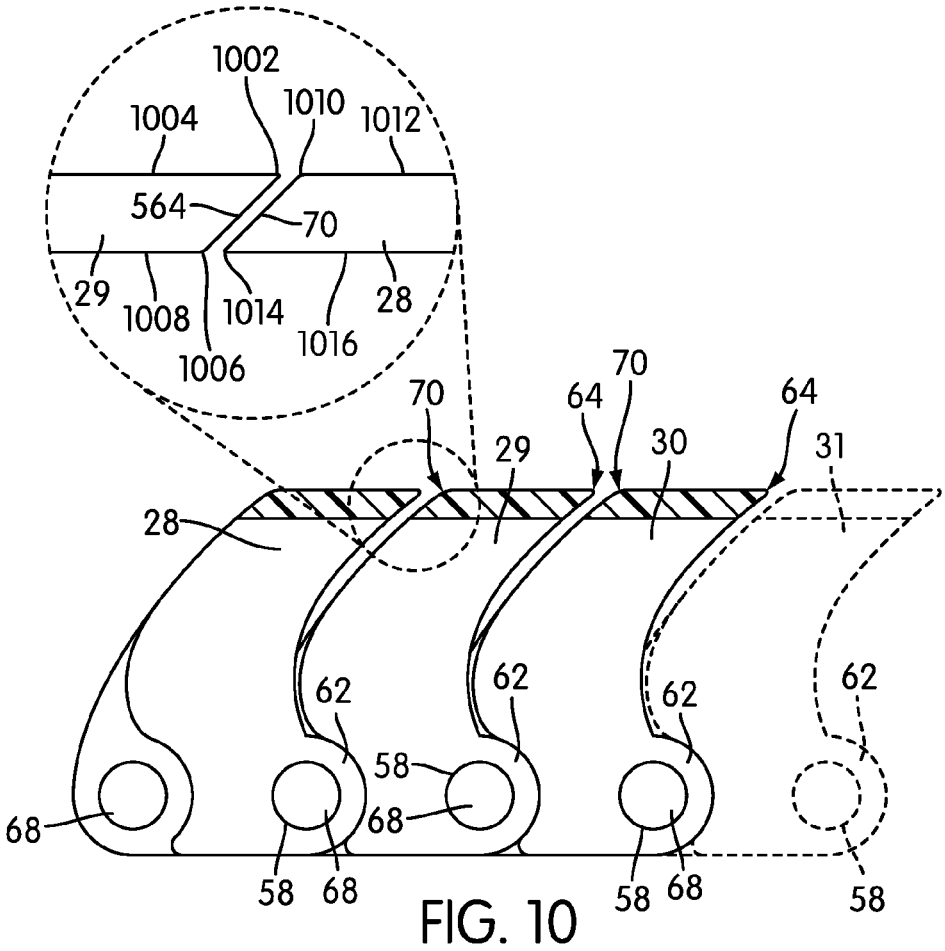
FIG. 10 is a cross-sectional view of the support segments, similar to the view of FIG. 9.

The connection of one support segment 30 with proximal support segments 28, 29 and a distal support segment 31 are shown in FIGS. 9 and 10 which are, respectively, a side elevational view and a sectional view of several assembled support segments 28, 29, 30, 31. As shown, first posts 66 engage with first holes 56 and second posts 68 engage with second holes 58 to connect support segments 28, 29, 30, 31. Because of the position of first and second mechanical connectors 52, 54, support segments 28, 29, 30, 31 are partially nested within one another once connected, with first and second mechanical connectors 52, 54 positioned on the interior.

Figure 11:
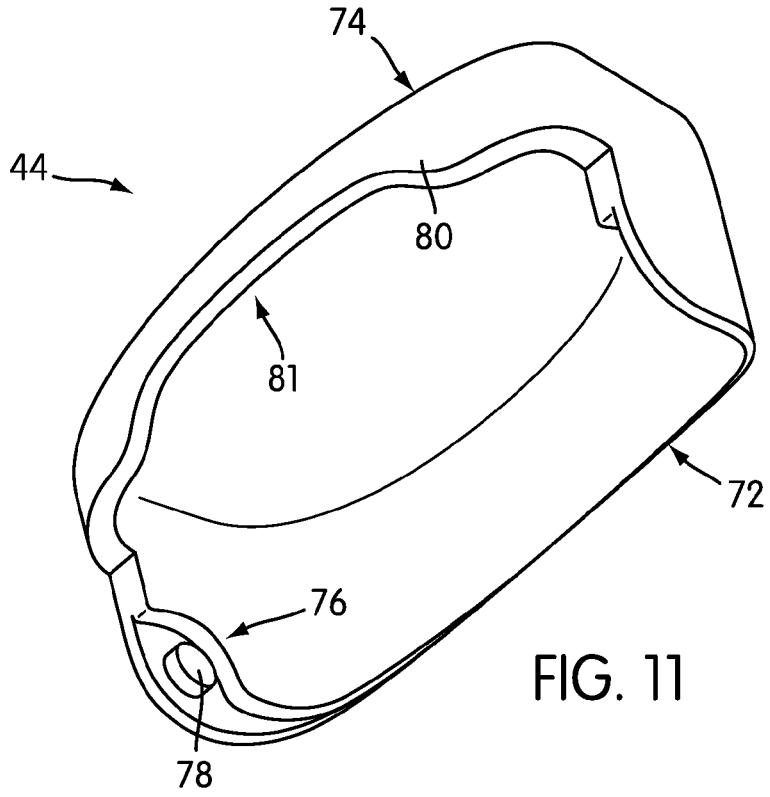
FIG. 11 is a perspective view of a distal cap support segment of the support system.

As was described above, support structures 18, 20, 22, 24 may have distal endcap support segments 44. FIG. 11 is a perspective view of an endcap support segment 44 in isolation. Endcap support segment 44 has a generally cup-like structure and includes a surrounding portion 72 and a top portion 74. Surrounding portion 72 is contoured to match the contours of middle segments 28, 29, 30, 31, 32, 33, 34, 36, 38, 40, 42 to which it is attached and with which it cooperates. An endcap mechanical connector 76 comprises a first endcap post 78 and a second endcap post (not shown in the view of FIG. 11). First endcap post 78 and second endcap post are slightly recessed with respect to the interior surface of endcap support segment 44 and are sized to engage and cooperate with corresponding first and second holes 56, 58 of support segments 28, 29, 30, 31, 32, 33, 34, 36, 38, 40, 42 such that the tops of first post 78 and second post are flush with the interior surface of endcap support segment 44 when engaged with another segment 28, 29, 30, 31, 32, 33, 34, 36, 38, 40, 42. Top portion 74 is adapted to protect the fingertip and includes an anterior edge 80 that extends proximally from top portion 74 and helps to retain the fingertip within endcap support segment 44.

Figure 12:
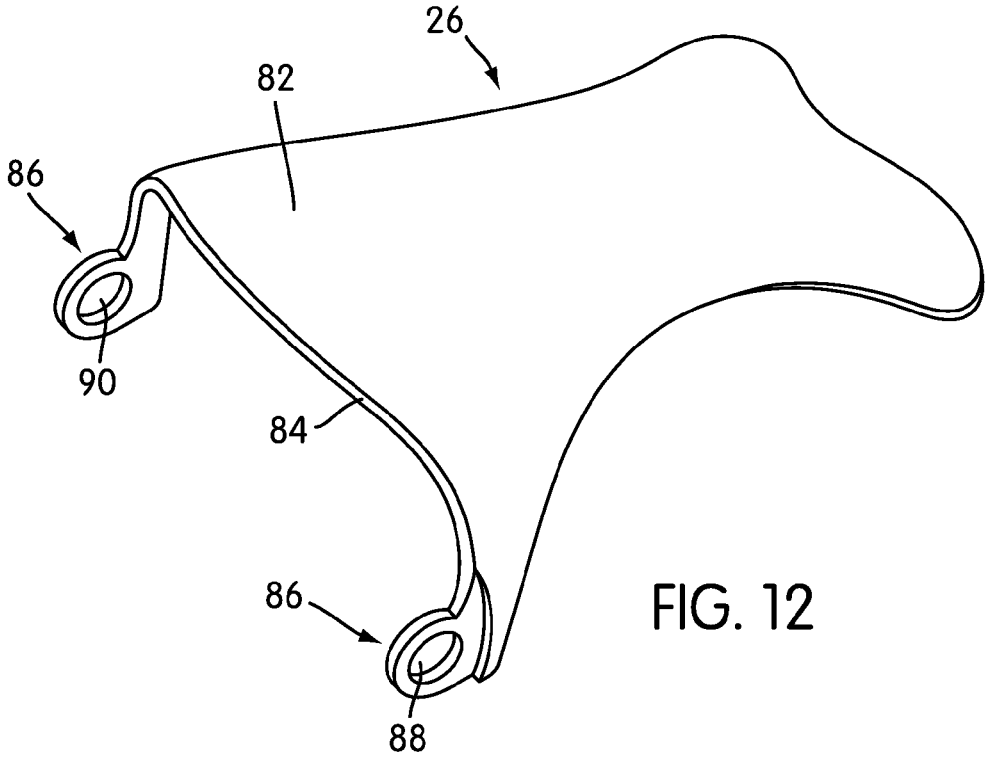
FIG. 12 is a perspective view of a proximal knuckle guard support segment of the support system.

FIG. 12 is a perspective view of proximal knuckle support segment 26. The knuckle support segment 26 includes a broad portion 82 that terminates distally in a distal edge 84. Broad portion 82 and distal edge 84 are sized and contoured to cooperate and engage with distal segments 28, 29, 30, 31, 32, 33, 34, 36, 38, 40, 42. Broad portion 82 also includes a knuckle support segment mechanical connector 86 which comprises first and second holes 88, 90 defined in first and second projecting portions 92, 94 that extend relatively inwardly from the outermost edge of broad portion 82 and are positioned so as to engage first and second posts 66, 68.

Broad portion 82 narrows proximally from distal edge 84 and curves arcuately inwardly, giving knuckle support segment 26 the overall shape of a "fish tail," as illustrated in FIG. 11. The curvature allows knuckle support segment 26 to protect the knuckle without obstructing flextural movement or interfering with other nearby knuckle support segments 26 from other fingers.

Figure 13:
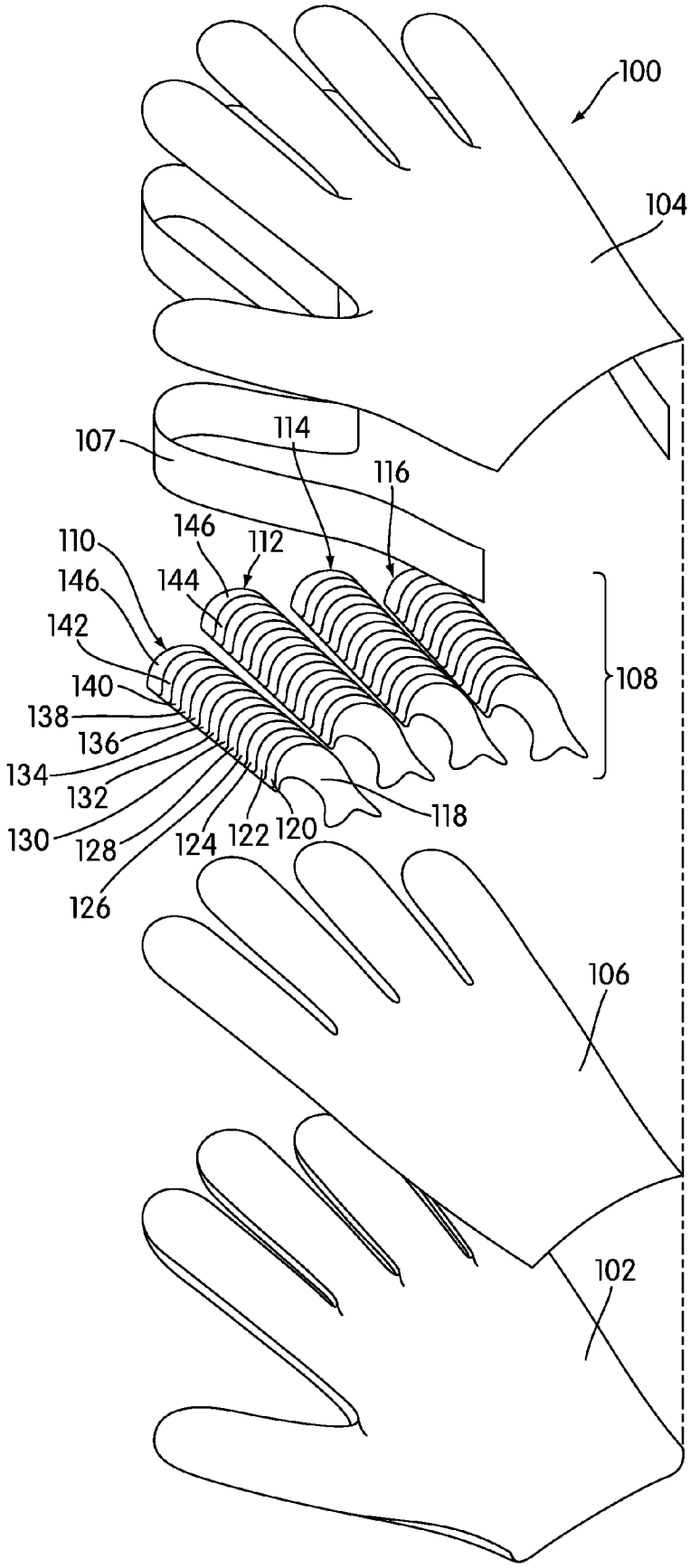
FIG. 13 is a perspective view of a glove with a support system according to another embodiment of the invention.

FIG. 13 is a perspective view of a glove, generally indicated at 100, with a support system 108 according to another embodiment of the invention. Glove 100 is similar in many respects to glove 10, and thus, those aspects of glove 100 that are not described in specific detail may be assumed to be similar to those of glove 10. Glove 100 is a right-handed glove; left handed gloves would typically be mirror images of glove 100.

Glove 100 includes three layers of fabric, a first layer 102, a second layer 104, and a third layer 106 intermediate the first and second layers 102, 104. As with glove 10, first layer 102 of glove 100 is adapted to fit proximate to the anterior of the hand, and in this embodiment may be relatively thickened with respect to second layer 104. First layer 102 may include any features that increase gripping or tactiliy, including rubberized or studded portions or foams. Third layer 106 of glove 100 is preferably relatively thin compared to first and second layers 102, 104 and is adapted to be sewn, fused, or otherwise attached between first and second layers 102, 104 to form a series of pockets. Support system 108 is adapted to rest within the pockets. Support system 108, which is similar in many respects to support system 12 of glove 10, includes four support structures 110, 112, 114, 116, one for each of the fingers. Correspondingly, third layer 106 is shaped so as to create four pockets for the four support structures 110, 112, 114, 116. Each support structure 110, 112, 114, 116 includes a knuckle support segment 118, a plurality of intermediate support segments 120, 122, 124, 126, 128, 130, 132, 134, 136, 138, 140, 142, 144 and an endcap support segment 146.

Figure 14:
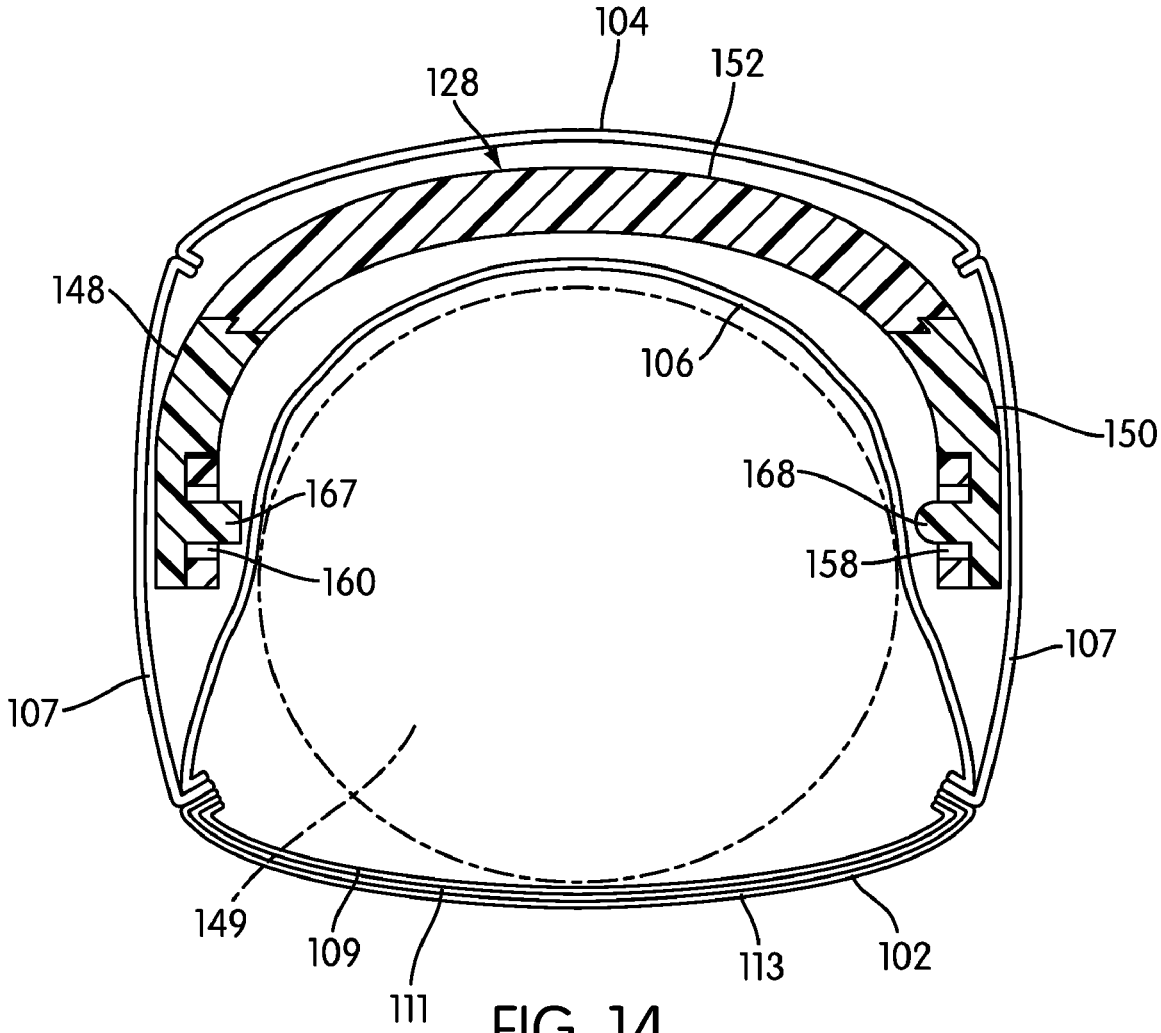
FIG. 14 is a sectional view of the glove of FIG. 13, taken in the axial plane through one of the fingers.

FIG. 14 is a sectional view of glove 100 taken in the axial plane, illustrating a finger 149 in phantom as it would appear in place inside glove 100. First, second, and third layers 102, 104, 106 meet at a stitch line 146 that extends around the circumference of glove 100. Support structures 110, 112, 114, 116 are disposed between second layer 104 and third layer 106. Specifically, FIG. 14 illustrates one intermediate support segment, generically indicated at 128 and representative of the features of all of the intermediate support segments, in section, disposed between second layer 104 and third layer 106 and encircling approximately 180° of the circumference of finger 149.

As is also shown FIG. 14, support segment 128 is disposed between second and third layers 104, 106 but, preferably, neither support segment 128 nor any other portion of support structures 110, 112, 114, 116 is secured in place between those two layers 104, 106. Thus, support structures 110, 112, 114, 116 are free to move along a proximal-distal line of motion within the pocket created by second layer 104 and third layer 106. In other embodiments, support structures 110, 112, 114, 116 may be secured in place between second layer 104 and third layer 106. However, leaving support structures 110, 112, 114, 116 free to move has certain advantages that will be described in greater detail below.

Figure 15:
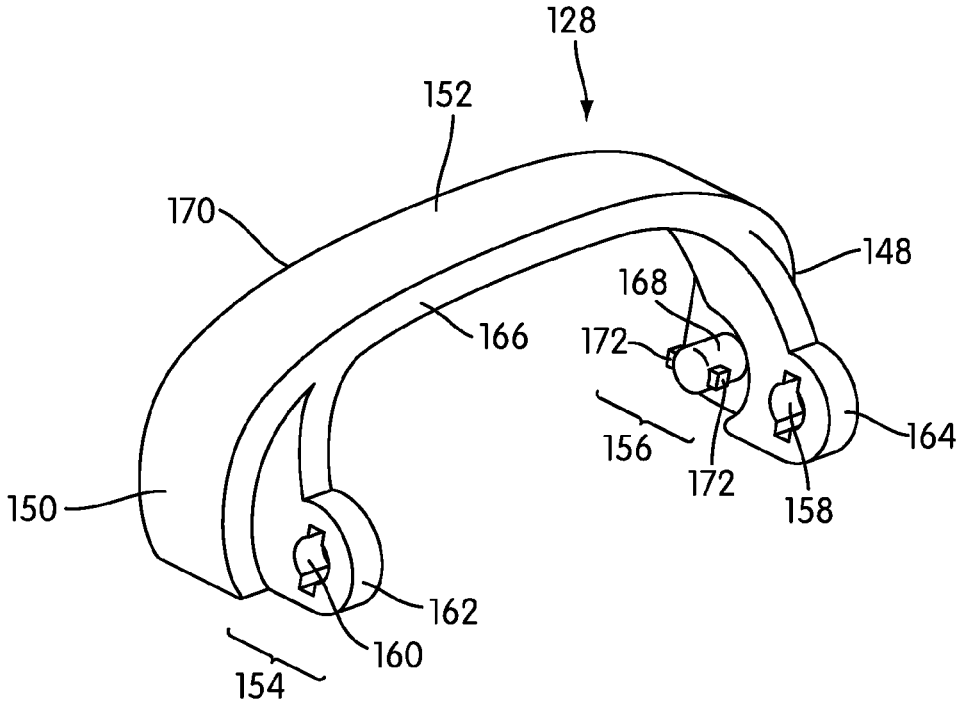
FIG. 15 is a perspective view of one intermediate support segment of the glove of FIG. 13.
Figure 16:
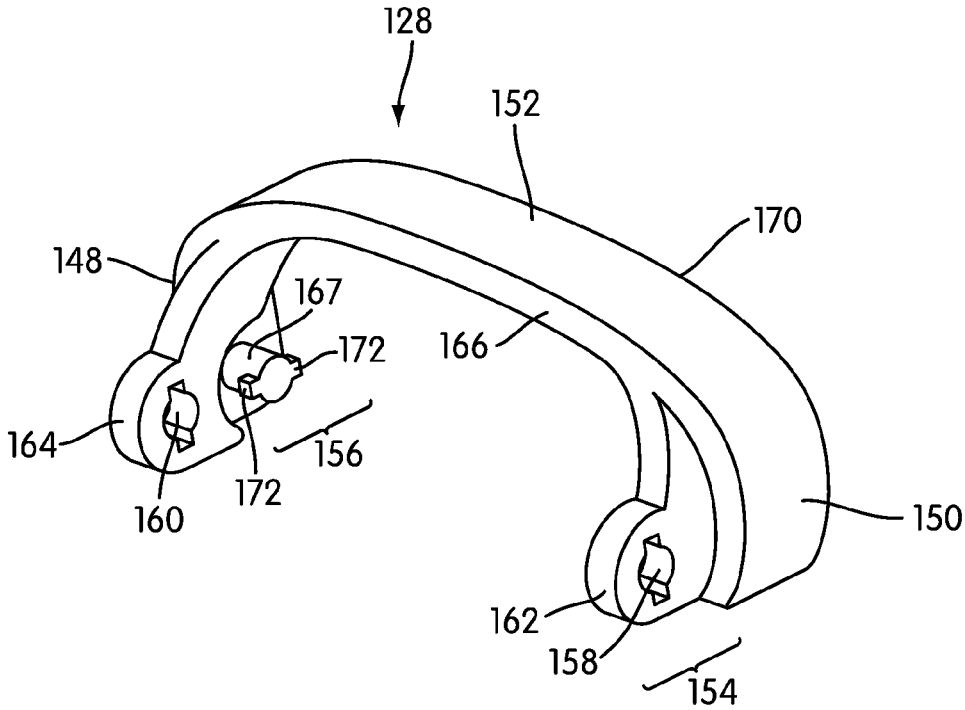
FIG. 16 is another perspective view of the intermediate support segment of the glove of FIG. 13.

FIGS. 15 and 16 are perspectives view of the generic intermediate support segment 128, which is representative of the features of the other intermediate support segments 120, 122, 124, 126, 130, 132, 134, 136, 138, 140, 142, 144. Support segment 128 has a general shape and features similar to those of support segment 28, including first and second end portions 148, 150 connected by a relatively flat central portion 152. When glove 100 is worn, one of end portions 148, 150 extends around the medial aspect of finger 149 and the other end portion 148, 150 curves around the lateral aspect of finger 149, as illustrated in FIG. 14. One difference between support segment 28 and support segment 128 is that support segment 128 is thicker than support segment 28, which provides more rigidity in the assembled support structures 110, 112, 114, 118.

Each of the first and second end portions 148, 150 has a first mechanical connector 154 and a second mechanical connector 156. With respect to the anatomical coordinate system of the fingers, first mechanical connector 154 is configured to associate support segment 128 with a more distal support segment 130; second mechanical connector 156 is configured to associate support segment 128 with a more proximal support segment 126.

First mechanical connector 154 comprises first and second openings 158, 160 defined opposite one another in respective outwardly extending first and second connecting portions 162, 164. Compared with holes 58, 60 of support segment 28, openings 158, 160 are keyed, having shapes that are not fully radially symmetric.

First and second connecting portions 162, 164 project distally from support segment 128 and arise as central portion 152 merges into first and second end portions 148, 150. As is shown in the figures, first and second connecting portions 162, 164 are slightly recessed so as to lie inwardly of a first edge 166 of support segment 28. First edge 166 of support segment 128 acts as the outermost edge of support segment 128 distally; its contours will be described in greater detail below.

Second mechanical connector 156 comprises first and second posts 167, 168 positioned opposite one another on opposite, inwardly oriented faces of first and second end portions 148, 150. First and second posts 167, 168 are sized to fit within and cooperate with respective first and second holes 158, 160 of another support segment 128 Adjacent first and second posts 167, 168 is a second edge 170, which acts as the outermost edge of support segment 128 proximally.

Compared with first and second posts 66, 68 of support segment 28, first and second posts 167, 168 of support segment 128 are longer than first and second posts 66, 68 and include a set of keyed projections 172 that arise from their lateral surfaces and correspond to the shape of first and second openings 158, 160. The corresponding shapes of openings 158, 160 and first 168 and second posts with keyed projections 172 allow first 168 and second posts and openings 158, 160 to remain in engagement, and prevent the respective components from accidental disengagement.

Figure 17:
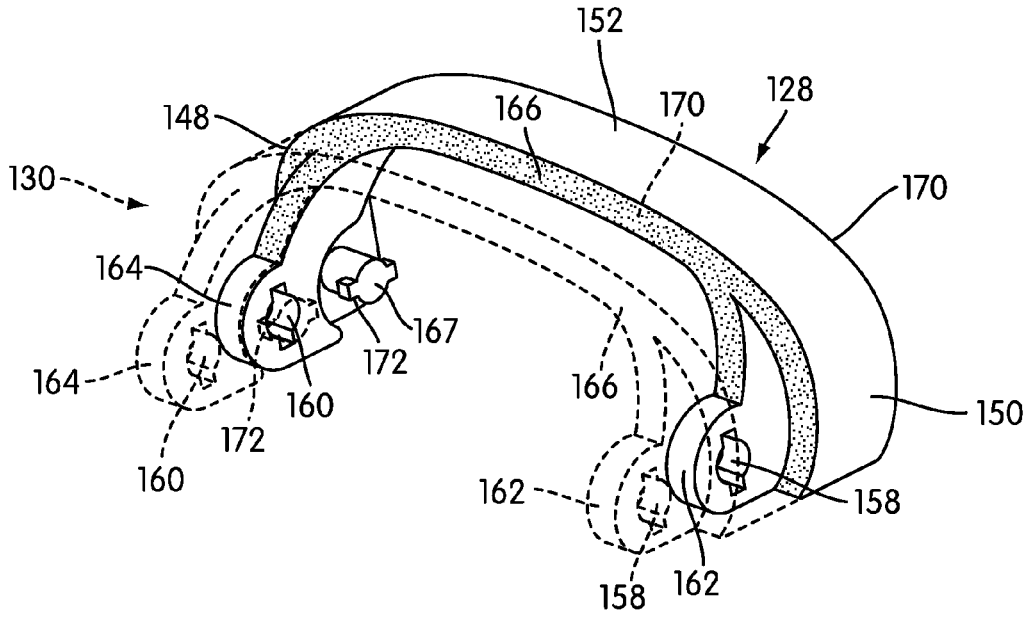
FIG. 17 is a perspective view of an intermediate support segment of the glove of FIG. 13 with another intermediate support segment shown in phantom, illustrating the extent of contact area between the two segments.

FIG. 17 is a perspective view of support segment 128 with a second interconnected support segment shown in phantom, illustrating the extent of contact area between the two at first edge 166. As shown, the contact between the two segments is in several planes, and is increased relative to the contact areas provided by the support structures 12, 14, 16, 18 of glove 10 due to the increased thickness of support segment 128.

Figure 18:
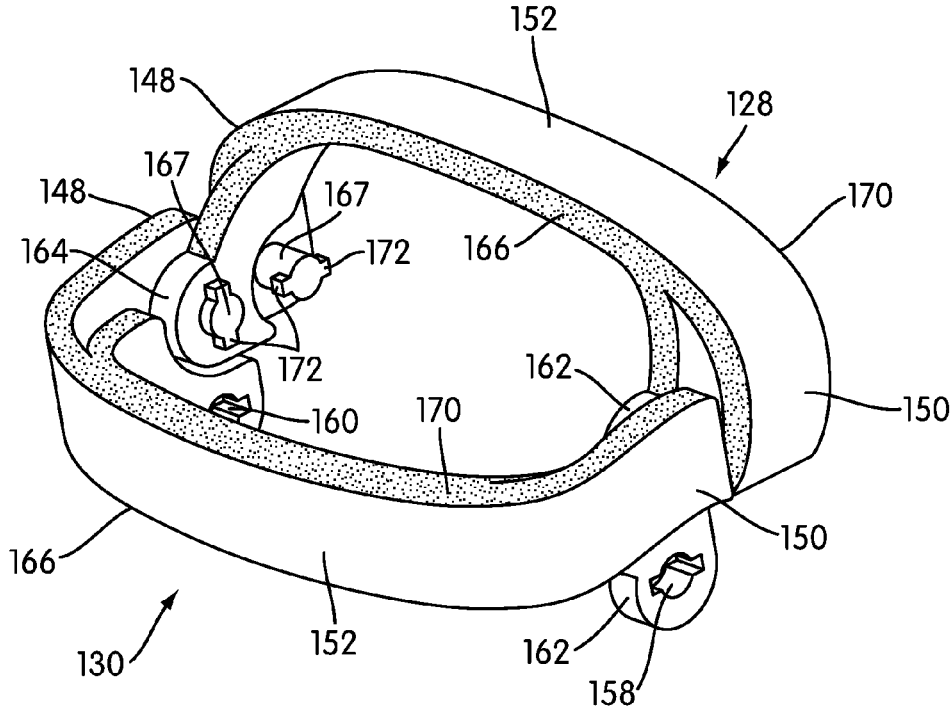
FIG. 18 is a perspective view of two connected intermediate support segments of the glove of FIG. 13, illustrating the pivoting of one with respect to the other.

FIG. 18 is a perspective view of support segment 128 and a more distal support segment 130 in engagement, showing the engaged relationship of the first and second posts 167, 168 and the first and second openings 158, 160. As shown, the position and extent of keyed projections 172 on first and second posts 167, 168 allow free rotation between adjacent support segments 128, 130, but restrict medial-lateral movement of the support segments 128, 130.

Figure 19:
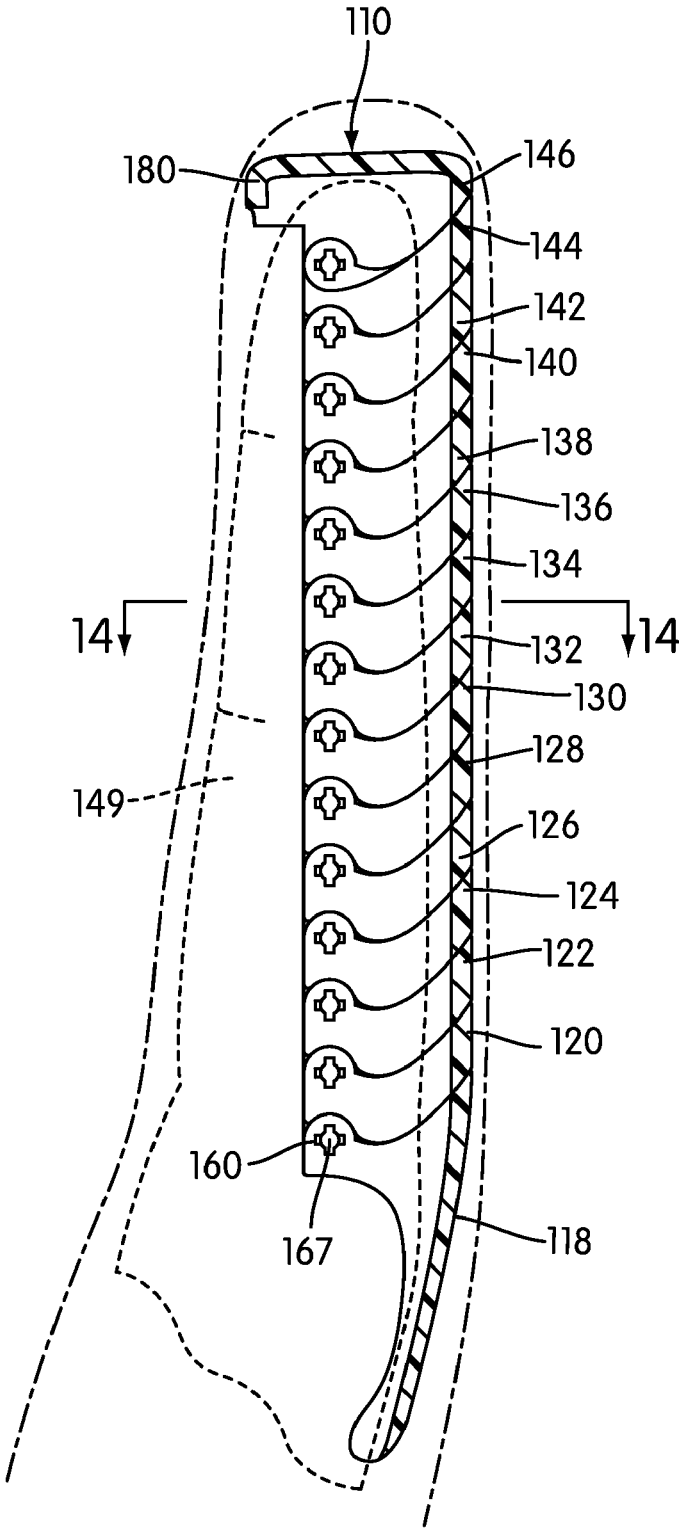
FIG. 19 is a side elevational sectional view of one finger of the glove of FIG. 13, illustrating a support structure in the extended position.

FIGS. 19-23 illustrate the functions and positions of a support structure, generically illustrated as support structure 110, inside glove 100. Specifically, FIG. 19 is a schematic side elevational sectional view of a portion of glove 100 with finger 149 inside. The view of FIG. 19 depicts the position of support structure 110 with finger 149 in the fully extended position. The tip of finger 149 is behind proximally-extending anterior edge 180 of endcap support segment 146.

As will be appreciated from FIG. 19, support structure 110 prevents hyperextension of finger 149 because, in the illustrated position, the various segments 120, 122, 124, 126, 128, 130, 132, 134, 136, 138, 140, 142, 144 abut and will thus not permit any additional extension or posterior movement.

Figure 20:
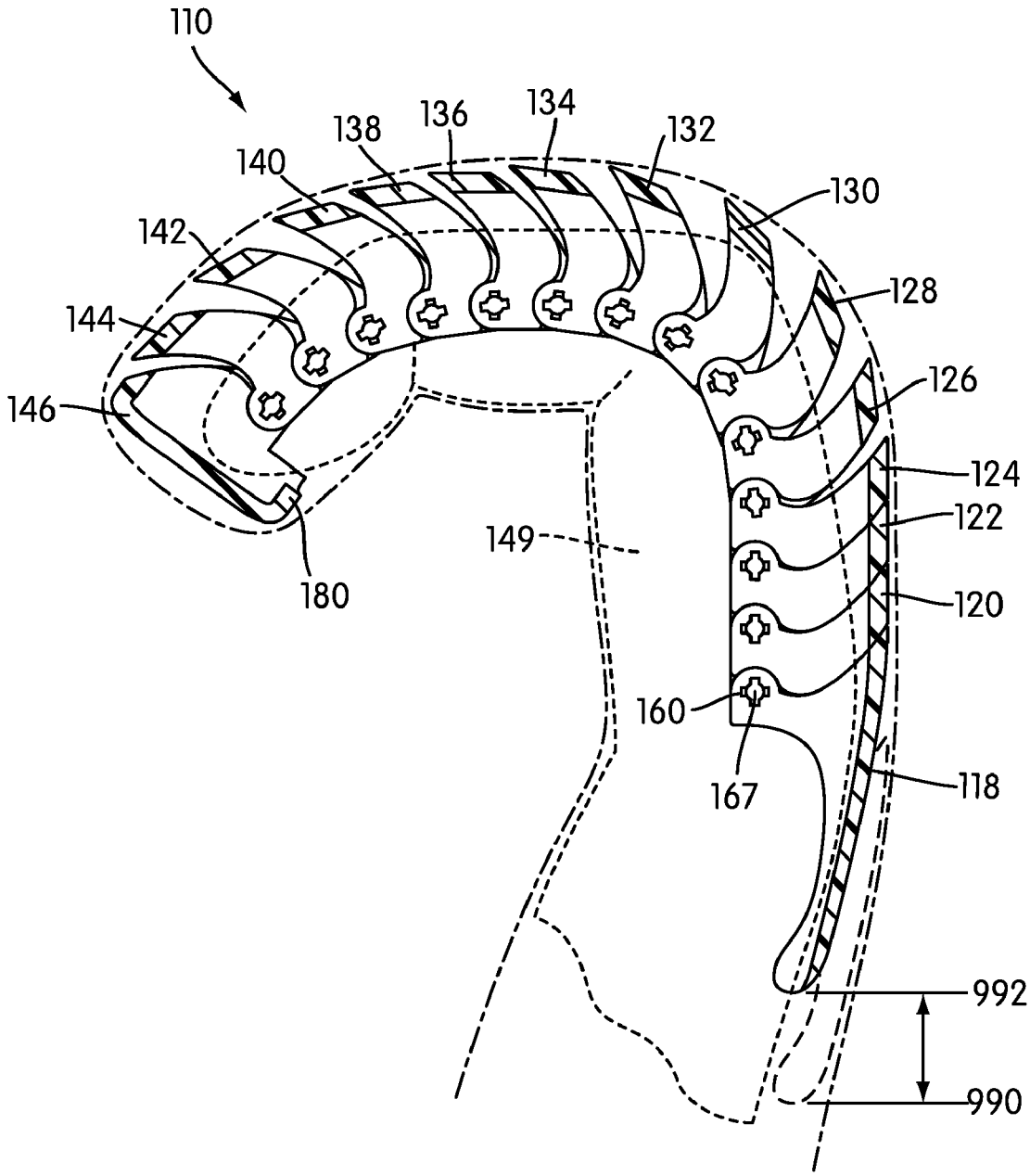
FIG. 20 is a side elevational sectional view similar to the view of FIG. 19, illustrating the support structure in a flexed position.

FIG. 20 is a schematic side elevational sectional view similar to the view of FIG. 19, but with finger 149, glove 100, and support structure 110 in flexion. Support structure 110 continues to protect the anterior aspect of finger 149. In the view of FIG. 19, the tip of finger 149 remains behind anterior edge 180 of endcap support segment 146, which causes support segment 110 to move in one-to-one or nearly one-to-one correspondence with finger 149.

In the description above, it was noted that support structure 110 is not secured in place, but rather, is free to slide along the pocket defined by second and third layers 104, 106. One advantage of this can be seen in FIG. 20. When finger 149 is in the fully extended position illustrated in FIG. 19, support structure 110 is in a first position, which is indicated in phantom at 990 in FIG. 20. As finger 149 flexes with the tip of finger 149 behind anterior edge 180 of endcap support segment 146, support structure 110 slides distally, so that the proximal edge of knuckle support segment 118 is in a position indicated at 992 in FIG. 20. This allows for a better fit of glove 100 and for more adaptable support from support structure 110.

Figure 21:
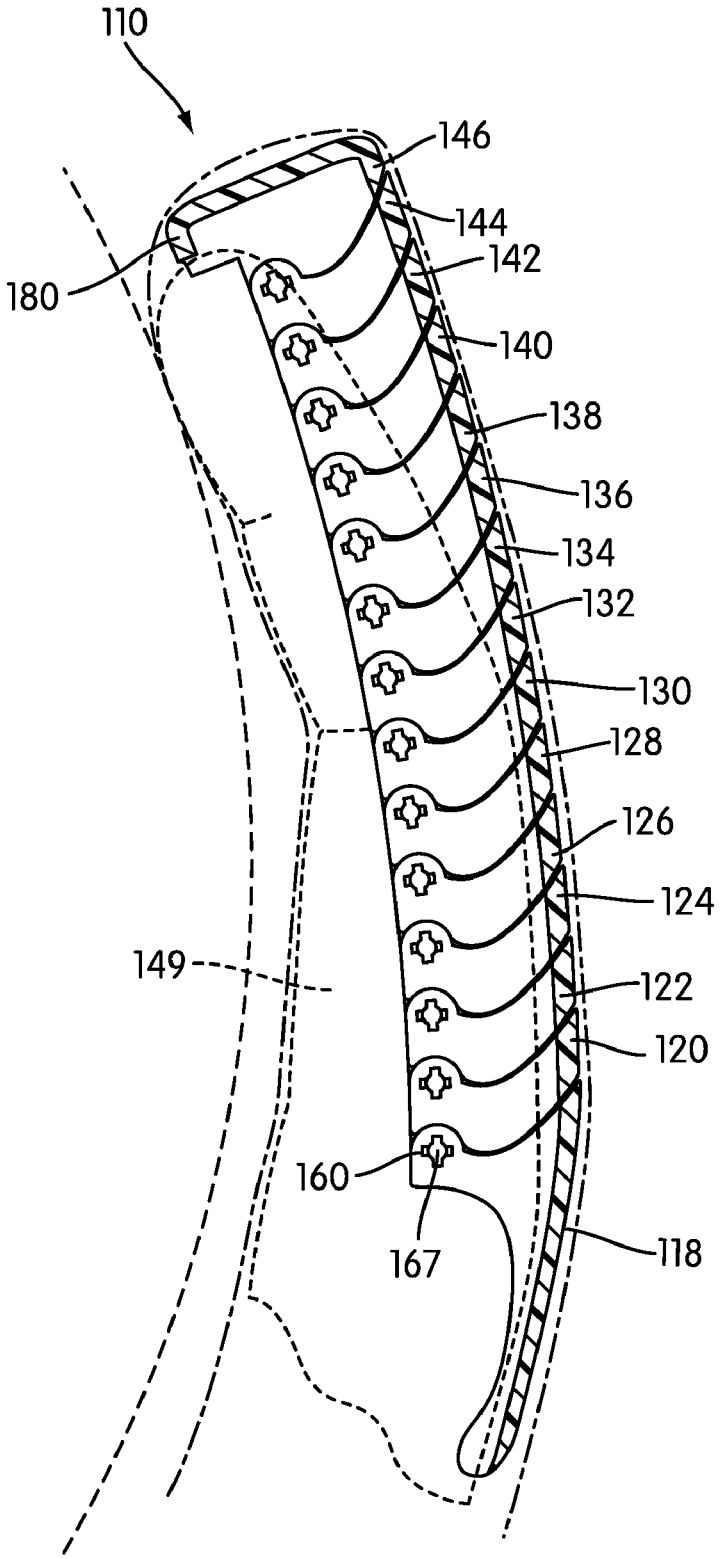
FIG. 21 is a side elevational sectional view similar to the view of FIG. 19, illustrating the support structure in a partially flexed position with a finger flexed and extending anteriorly of the support structure.

FIG. 21 is a schematic side elevational sectional view similar to the views of FIGS. 19 and 20. FIG. 21 illustrates a variation on the movement in FIG. 19. In FIG. 21, finger 149 is not behind anterior edge 180 of endcap support segment 146. Specifically, as finger 149 flexes in the position shown in FIG. 21, it pushes first layer 102. Eventually, since first layer 102 is connected to second and third layers 104, 106, support structure 110 will be pulled into partial flexion by forces exerted on it through first, second, and third layers 102, 104, 106 of glove 100, as shown in FIG. 21. Therefore, as shown in FIG. 21, finger 149 is more flexed than support structure 110, and there is only an indirect correspondence between the degree of flexion of finger 149 and the degree of flexion of support structure 110.

The position of FIG. 21 may be helpful in some applications in which the wearer is attempting to catch or grip an object. In essence, the position of FIG. 21 allows finger 149 to move relatively freely while support structure 110 remains behind to act as a backstopping support within glove 100.

Figure 22:
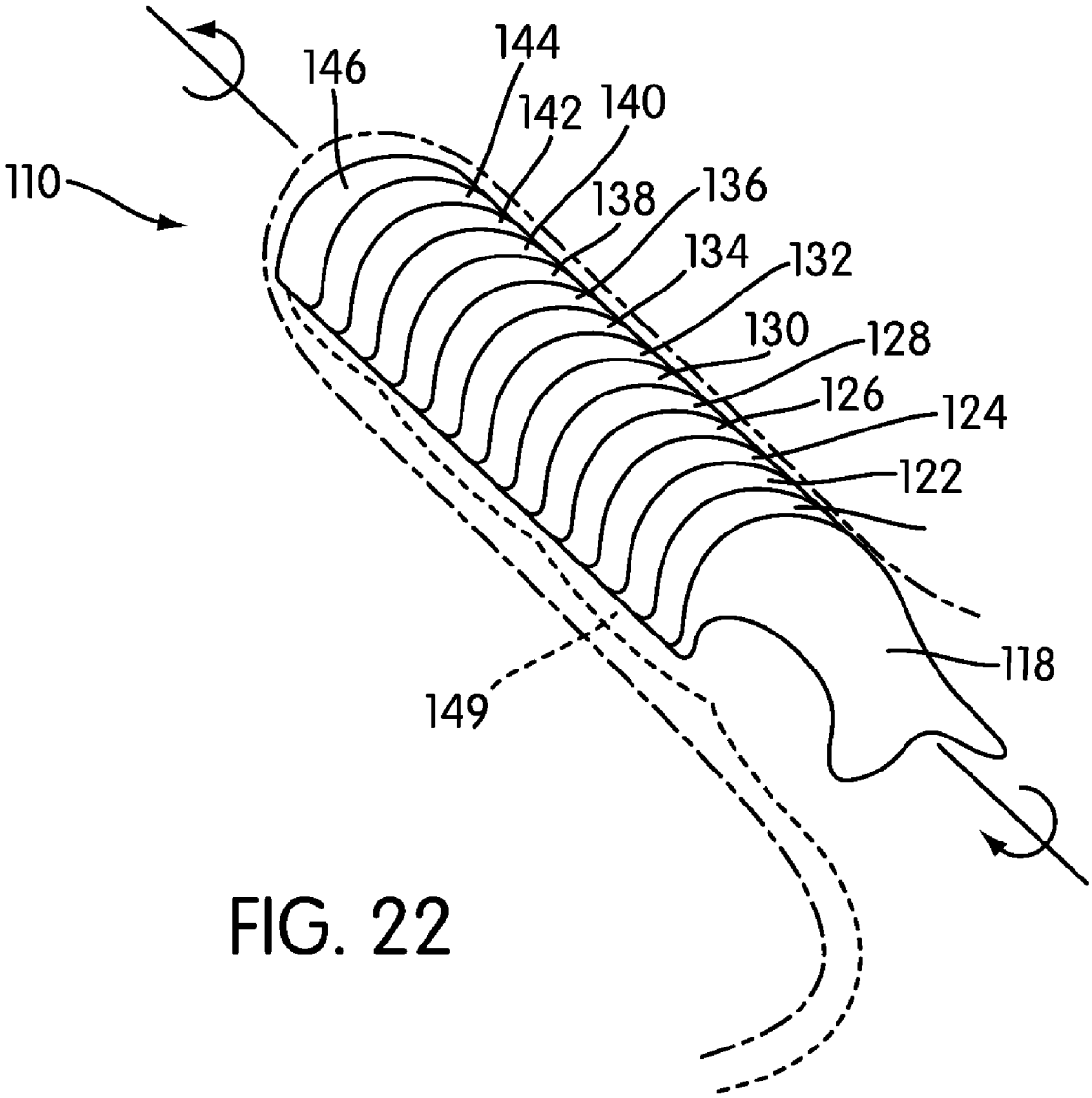
FIG. 22 is a schematic perspective view of a support structure, illustrating its resistance to torsional forces.
Figure 23:
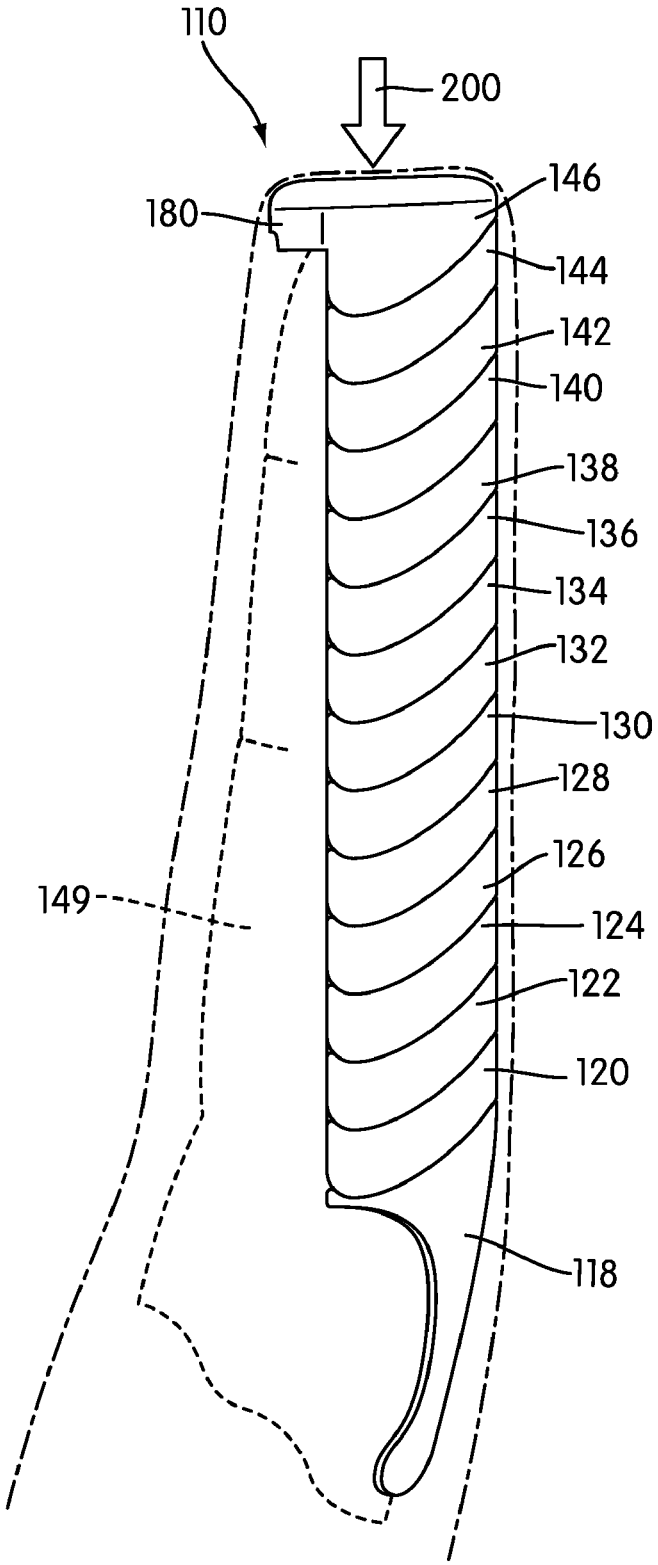
FIG. 23 is a side elevational view of a support structure, illustrating its resistance to compressive axial forces.

FIGS. 22 and 23 are, respectively, a schematic perspective and side elevational view of support structure 110, illustrating the result with applied torsional and axial forces. As shown in FIG. 22, support structure 110 resists twisting upon the application of torsional forces because of the shape and close engagement of the support segments 118, 120, 122, 124, 126, 128, 130, 132, 134, 136, 138, 140, 142, 144, 146.

FIG. 23 illustrates the application of a compressive axial force to support structure 110. The overall shape of support structure 110 tends to reduce the likelihood of failure by column buckling. Therefore, support structure 110 protects finger 149 against, for example, sudden axial compressive loads that might cause a finger jamb or a crush injury along the finger.

Figure 24:
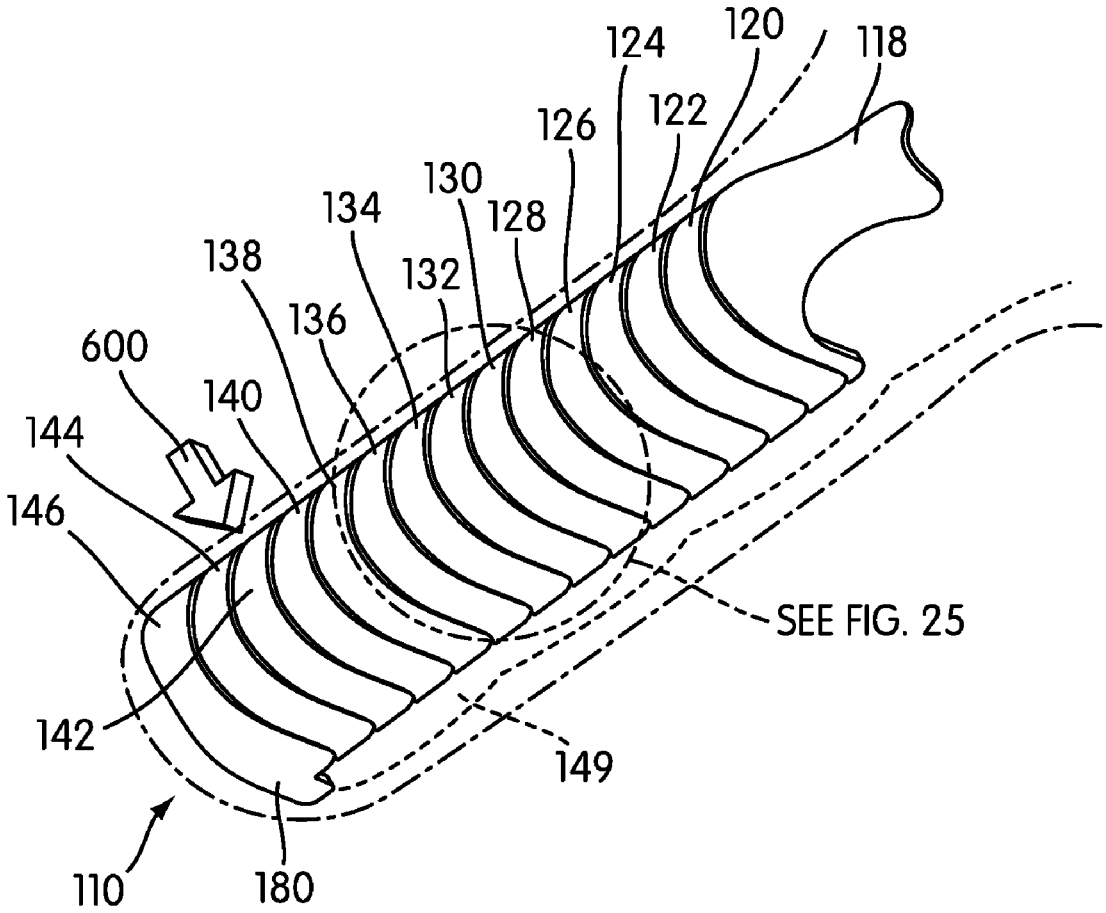
FIG. 24 is a perspective view of a support structure, illustrating its resistance to side impact forces.
Figure 25:
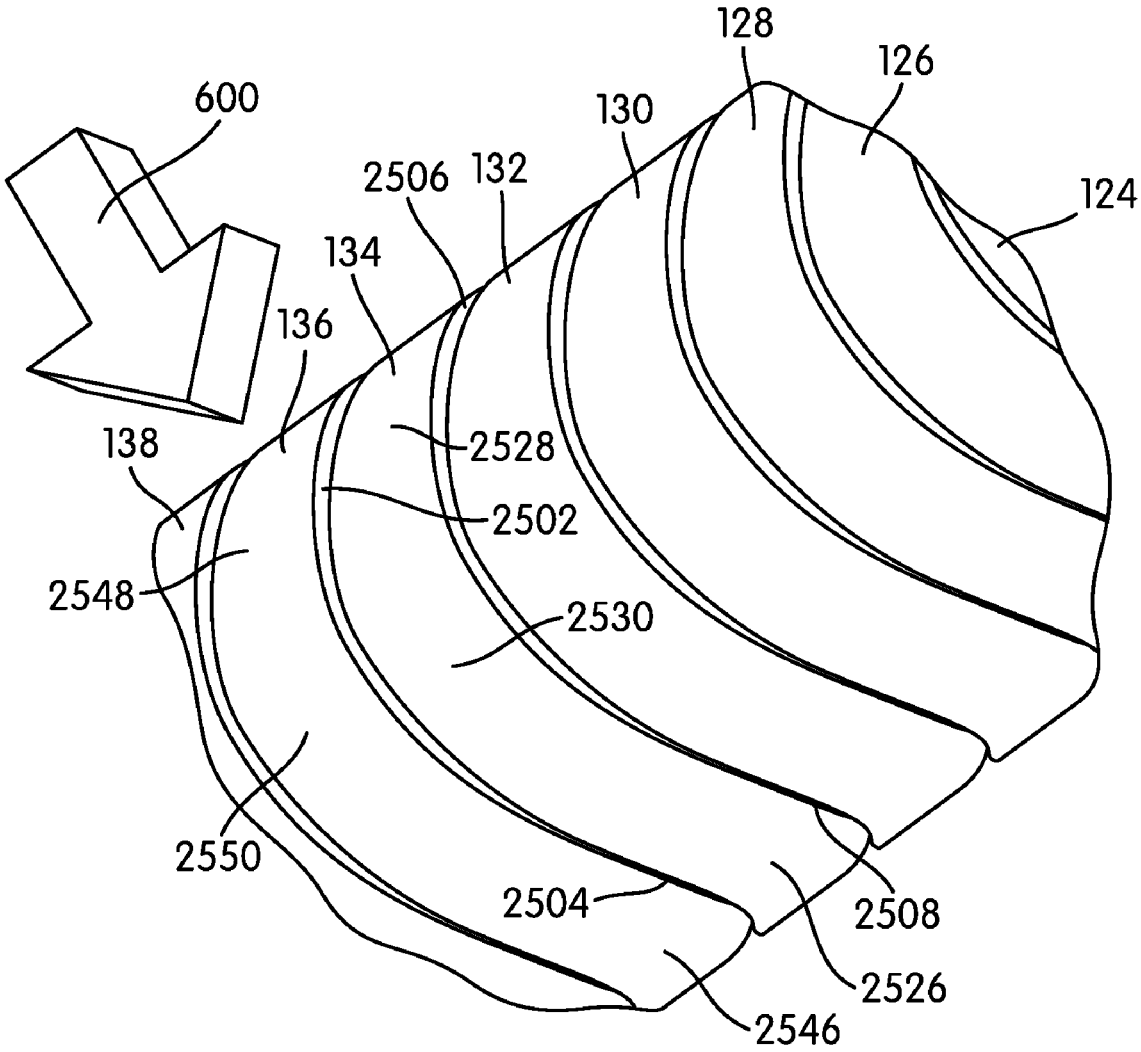
FIG. 25 is a magnified perspective view of a portion of the support structure of FIG. 24, illustrating its resistance to side impact forces in more detail.

FIG. 24 is a perspective view of a support structure 110 illustrating the application of a side impact force, indicated by arrow 600 at a point along the side face of support structure 110. FIG. 25 is a magnified perspective view of a portion of FIG. 24, illustrating the response of support structure 110.

As shown in FIGS. 24 and 25, side impact force 600 impacts support structure 110 around one of the middle support segments. In the example shown in FIGS. 24 and 25, middle support segment 136 is referred to as a "first middle support segment" and middle support segment 134 is referred to as a "second middle support segment." The terms, "first" and "second" are used to simply refer to the middle support segments and do not indicate or relate to their position with respect to other middle support segments, and endcap segment or a knuckle segment.

First middle support segment 136 includes first end portion 2546 and second end portion 2548. As disclosed above, these end portions 2546 and 2546 extend circumferentially from central portion 2550 of first middle segment 136. In the example shown in FIGS. 24 and 25, impact force 600 contacts support structure 110 around first middle support segment 136, and particularly, around the second end portion 2548 of first middle support segment 136.

The shape of support structure 110 helps to reduce the effect of impact force 600 on a wearer's hand. Second end portion 2548 is disposed around one side of the wearer's finger, and helps to absorb and distribute impact force 600. Without the curved shape of middle support segment 136, and the position of second end portion 2548 around the side of the wearer's finger, there would be little besides one of the glove layers (102 or 104) or gusset 107 (see FIG. 14) to stop impact force 600. The curved shape of support structure 110 around a wearer's finger and proximate the side of the wearer's finger helps to reduce the effects of side impact forces like side impact force 600.

In the Example shown in FIGS. 24 and 25, side impact force 600 strikes first middle support segment 136, usually through a glove layer, for example, glove layer 104 or gusset 107 (see FIG. 14). Side impact force 600 is absorbed and distributed by second end portion 2548 of first middle support segment 136. Second end portion 2548 helps to prevent side impact force 600 from directly striking the wearer's finger.

In some cases, and with some types of impacts, support structure 110 can also distribute the load of side impact force 600 in the following way. Side impact force 600 causes the distance between at least two support segments, in this case, middle support segments 134 and 136 to increase on one side, as indicated by first gap 2502, and to decrease on the opposite side of support structure 110, as indicated by second gap 2504. Specifically, as shown in FIG. 25, first gap 2502 is disposed between second end portion 2548 of first middle support segment 136 and second end portion 2528 of second middle support segment 134. And second gap 2504 is disposed between first end portion 2546 of first middle support segment 136 and first end portion 2526 of second middle support segment 134. The gap between adjacent support segments on the side of the impact can increase, while the gap between adjacent support segments on the opposite side of the impact can decrease.

Because of the nature of the engagement of middle support segments 134 and 136, both in terms of shape and they way they are connected to one another, the amount of movement caused by impact force 600 is limited. At second gap 2504, middle support segments 134 and 136 are in full abutment, which prevents any further gap opening at first gap 2502.

Depending on the nature of the impact force and its location, the phenomenon illustrated by first gap 2502 and second gap 2504 may occur between other adjacent support segments as well, and in some cases, can occur along the length of support structure 110. In the example shown in FIGS. 24 and 25, other segments have also pivoted or shifted along the axial length of support structure 110. In the example shown in FIG. 25, this change in gaps also occurs between second middle support segment 134 and third middle support segment 132. Comparing the size of third gap 2506, which is on the side of the support structure 110 receiving the side impact, with the size of fourth gap 2508, which is on the side opposite the side receiving the side impact, the difference in gap size between second middle support segment 134 and third middle support segment 132 can be observed. This change in gap size can be observed in other pairs of adjacent support segments as well. The complex curvature, shape, and close engagement of segments tend to distribute the force along the entire support segment 110 and dissipate the force to some degree without subjecting the wearer to excessive lateral bending forces or bending displacement.

While various embodiments of the invention have been described, the description is intended to be exemplary, rather than limiting and it will be apparent to those of ordinary skill in the art that many more embodiments and implementations are possible that are within the scope of the invention. Accordingly, the invention is not to be restricted except in light of the attached claims and their equivalents. Also, various modifications and changes may be made within the scope of the attached claims.

What is claimed is:

1. A glove comprising:

a support system comprising:

at least one support structure including a first segment and an adjacent second segment;

the first segment including a first mechanical connector including at least one hole, and a second mechanical connector including at least one post;

the second segment including a first end portion having a first inner surface and a second end portion having a second inner surface facing the first inner surface, the second segment including a first mechanical connector including at least one hole, and a second mechanical connector including at least one post disposed on the first inner surface of the first end portion of the second segment;

wherein the hole of the first mechanical connector of the first segment receives the post of the second mechanical connector of the second segment thereby connecting the first segment with the second segment;

wherein the post pivots within the hole allowing the first segment to pivot with respect to the second segment;

wherein the post is integrally formed on the second connector; and wherein a distal edge of the first segment extends further distally than the post of the first mechanical connector of the first segment.

2. The glove according to claim 1, wherein the first segment is substantially similar to the second segment.

3. The glove according to claim 1, wherein the first mechanical connector of the first segment includes a pair of holes, one of the holes being disposed on a first end portion of the first segment and the other of the holes being disposed on a second end portion of the first segment.

4. The glove according to claim 3, wherein a central portion extends between the first and second end portions of the first segment.

5. The glove according to claim 4, wherein the central portion includes a first edge disposed proximal to the first mechanical connector.

6. A glove comprising:

a first layer configured to contact and substantially cover a wearer's hand;

a support system comprising:

a support structure including a plurality of support segments;

the support structure having a first support segment configured to pivot with respect to a second support segment; and wherein the first support segment includes a circumferentially curved portion;

wherein the first support segment is disposed distally with respect to the second support segment; and wherein the second segment includes a circumferentially curved portion extending axially towards the first support segment and axially distal to a mechanical connector of the first support segment.

7. The glove according to claim 6, wherein the circumferentially curved portion of the second segment corresponds to the portion of the first segment that is circumferentially curved.

8. The glove according to claim 7, wherein the second support segment includes a first end portion having a first outer surface and a second end portion having a second outer portion facing away from the first outer surface, the first and second outer surfaces each including recessed connecting portions.

9. The glove according to claim 6, wherein the first support segment is connected to the second support segment by the mechanical connector of the first support segment, the mechanical connector being circumferentially spaced from the circumferentially curved portion of the first support segment.

10. The glove according to claim 6, further comprising a second layer, wherein the support system is disposed between the wearer's hand and the second layer.

11. The glove according to claim 10, further comprising a third layer, wherein the support system is disposed between the second layer and the third layer.

12. The glove according to claim 11, wherein the support structure slides axially with respect to the second and third layer.

13. A glove comprising:

a first layer configured to contact a first side of a wearer's hand;

a second layer configured to contact a second and opposite side of the wearer's hand;

a support system associated with the second layer, the support system comprising:

a support structure associated with a finger and including a plurality of support segments;

the support structure having a first support segment configured to pivot with respect to a second support segment;

wherein the first support segment includes a central portion disposed between a first end portion and a second end portion, the central portion configured to extend across a top of the finger and having a distal edge extending further distally than the first and second end portions;

wherein the first end portion is disposed on a side of the finger and configured to absorb a side impact acting on the first end portion of the first support segment by being displaced relative to the second support segment in response to the side impact; and wherein the first end portion of the first support segment engages with a first end portion disposed on the second support segment to cover the side of the finger.

14. The glove according to claim 13, wherein the second segment is configured to be displaced in response to the side impact acting on the first end portion of the first support segment.

15. The glove according to claim 14, wherein the first support segment is substantially similar to the second support segment.

16. The glove according to claim 13, wherein the first support segment is configured to absorb the side impact by being displaced such that a first gap disposed between the first end portion of the first support segment and a first end portion of the second support segment increases.

17. The glove according to claim 16, wherein the first support segment is configured to absorb the side impact by being displaced such that a second gap disposed between the second end portion of the first support segment and a second end portion of the second support segment decreases.

18. The glove according to claim 17, wherein the support structure further includes a third support segment configured to be displaced in response to the side impact such that a third gap disposed between the first end portion of the second support segment and a first end portion of the third support segment increases.

19. The glove according to claim 18, wherein the support structure further includes a third support segment configured to be displaced in response to the side impact such that a fourth gap disposed between the second end portion of the second support segment and a second end portion of the third support segment decreases.

20. A glove comprising:

a first layer configured to contact a palm side of a wearer's hand;

a second layer and a third layer disposed opposite to the first layer, wherein at least one of the second layer and the third layer is configured to contact a back side of a wearer's hand;

wherein the second layer and the third layer are associated with each other on a finger of the glove to form a pocket between the second layer and the third layer, wherein an interior of the pocket is continuous;

a support system disposed in the pocket;

the support system comprising:

a support structure including a first segment, a second segment rotatably connected to the first segment, and a knuckle support segment, the knuckle support segment having two ends and a middle between the two ends, the two ends being wider than the middle; and wherein the support system slides freely within the pocket so that a proximal edge of the knuckle support segment moves distally within the interior of the pocket when the support system is flexed.

21. The glove according to claim 20, wherein the second layer is an external layer.

22. The glove according to claim 21, wherein the third layer is an internal layer disposed inside the second layer.

23. The glove according to claim 22, wherein at least one of the first segment and the second segment remain substantially fixed in position with respect to the interior of the pocket.

* * * * *